US008669452B2

(12) United States Patent
Waitzman, III et al.

(10) Patent No.: US 8,669,452 B2
(45) Date of Patent: Mar. 11, 2014

(54) DRUM RUG AND GIG BAG IN ONE

(75) Inventors: James W. Waitzman, III, Homewood, AL (US); Zachary A. Griggs, Atlanta, GA (US); Wesley McDonald, Birmingham, AL (US)

(73) Assignee: Plamron, LLC, Homewood, AL (US)

( * ) Notice: Subject to any disclaimer, the term of this patent is extended or adjusted under 35 U.S.C. 154(b) by 105 days.

(21) Appl. No.: 13/247,177

(22) Filed: Sep. 28, 2011

(65) Prior Publication Data

US 2013/0074676 A1 Mar. 28, 2013

(51) Int. Cl.
*G10D 13/02* (2006.01)

(52) U.S. Cl.
USPC ..... 84/411 R

(58) Field of Classification Search
USPC ..... 84/411 R
See application file for complete search history.

(56) References Cited

U.S. PATENT DOCUMENTS

| | | | | |
|---|---|---|---|---|
| 1,217,357 | A * | 2/1917 | Sparrow | 383/39 |
| 3,096,677 | A | 7/1963 | Ryan | |
| 4,240,646 | A | 12/1980 | Scott | |
| 4,334,612 | A * | 6/1982 | Beato | 206/314 |
| 441,398 | A | 4/1984 | Baker | |
| 4,441,398 | A * | 4/1984 | Baker | 84/421 |
| 5,161,761 | A | 11/1992 | May | |
| D352,951 | S | 11/1994 | Choate | |
| 5,994,634 | A | 11/1999 | Cady | |
| 7,880,074 | B2 | 2/2011 | Baskerville | |
| 2010/0236382 | A1 | 9/2010 | Simbirdi | |

* cited by examiner

*Primary Examiner* — Christopher Uhlir
(74) *Attorney, Agent, or Firm* — Angela Holt; Bradley Arant Boult Cummings LLP

(57) ABSTRACT

A drum rug lays flat for a performance, and includes a rigid drum stop extending upwards from the front edge to prevent the bass drum from edging forward during a performance. The drum rug includes left and right flaps that can be releasably connected to drum rug left and right edges to form an enclosure, with the flaps forming the ends of the enclosure and the body of the drum rug forming the sides of the enclosure. Equipment can be placed in the enclosure for carrying, and the drum rug can be laid flat to support drums for performances.

19 Claims, 4 Drawing Sheets

DRUM RUG AND GIG BAG IN ONE

BACKGROUND OF THE INVENTION

1. Field of the Invention

The current invention relates to drum rug used as a base for playing drums, where the drum rug converts to a gig bag for carrying items.

2. Background of the Invention

Many bands will travel from one location to another to play. These bands will often use gig bags to carry equipment into and out of each location prior to and after a performance. The gig bag is typically a relatively large bag that can hold several different items the band uses for its performance. It is not uncommon for bands to travel to many different locations in relatively rapid succession, so the bands become familiar with setting up their equipment at a new location. The bands utilize gig bags of various dimensions and configurations to facilitate the repeated movement from one location to another.

Drummers frequently have several pieces of equipment to set up and take down for each performance. A drummer also tends to beat and pound on the drums during a performance, so the equipment must be robust and solid to withstand the drumming performance. The beating and pounding can also cause the various drums to move or shift during a performance. The gradual movement of the drums is usually more prevalent for certain drums, such as the bass drum which is typically beat quite hard from an essentially horizontal direction. This beating can make the bass drum "walk" forward during a performance. The hi-hat cymbals are part of many drum sets, and operation of the foot pedal tends to "walk" the hi-hat as well. In general, equipment operated with a foot pedal tends to "walk" more than other equipment, but many other drum pieces that do not have foot pedals can also move during use.

A drummer practices with the drums in a fixed, known position, and the drummer becomes familiar with the location of each drum. The drummer expects the drums to be in the proper location during a performance, and the drummers reach and direction of movement depend on drums being in the expected position. When one or more drums move or shift during a performance, the drummer may have difficulties because the drums are no longer in a playable position.

A drum set often occupies a relatively large footprint on a stage. In fact, the drummer will often require more stage area than any other band member. The stages of many performance venues have limited area, so band members will often attempt to limit the amount of space they take up. When drums move during a performance, they typically move away from the drummer, such that the drum set begins to take up more and more area as the performance progresses.

Many bands desire equipment that will help secure drums during a performance, and many bands also desire to minimize the amount of equipment that has to be moved for each performance. If a piece of equipment can be used during a performance, and also used to facilitate moving before and after a performance, it can reduce the total number of items the band has to move.

BRIEF SUMMARY OF THE INVENTION

The drum rug of this disclosure lays essentially flat for a performance or practice, and includes a rigid drum stop extending upwards from the front edge to prevent the bass drum, hi-hat cymbals, or other equipment from edging forward during a performance. The drum rug includes left and right flaps that can be releasably connected to left and right edges of the drum rug to form an enclosure, with the flaps forming the ends of the enclosure and the body of the drum rug forming the sides of the enclosure. Equipment can be placed in the enclosure for carrying, and the drum rug can be laid flat to support drums for performances.

DETAILED DESCRIPTION

Drum Rug

Figure 1:
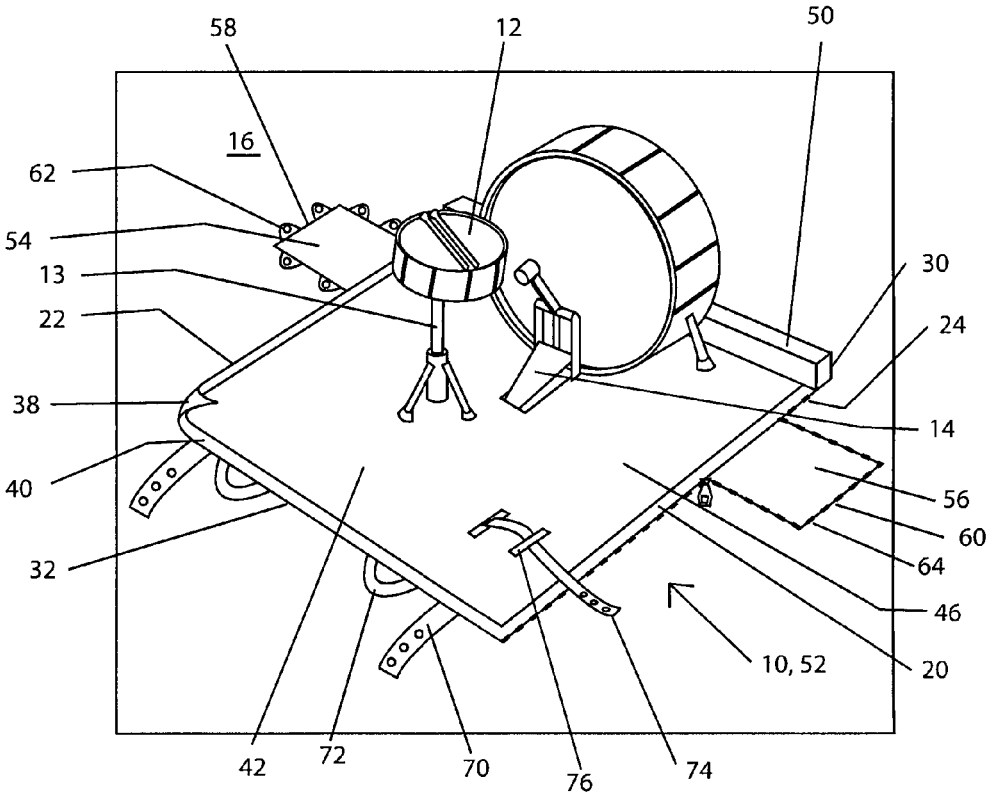
FIG. 1 is a perspective view of one embodiment of the drum rug laid flat on a stage floor, with drums positioned on top of the drum rug. This figure shows a zipper on the right edge and buttons on the left edge to indicate the variety of connectors that can be used.
Figure 2:
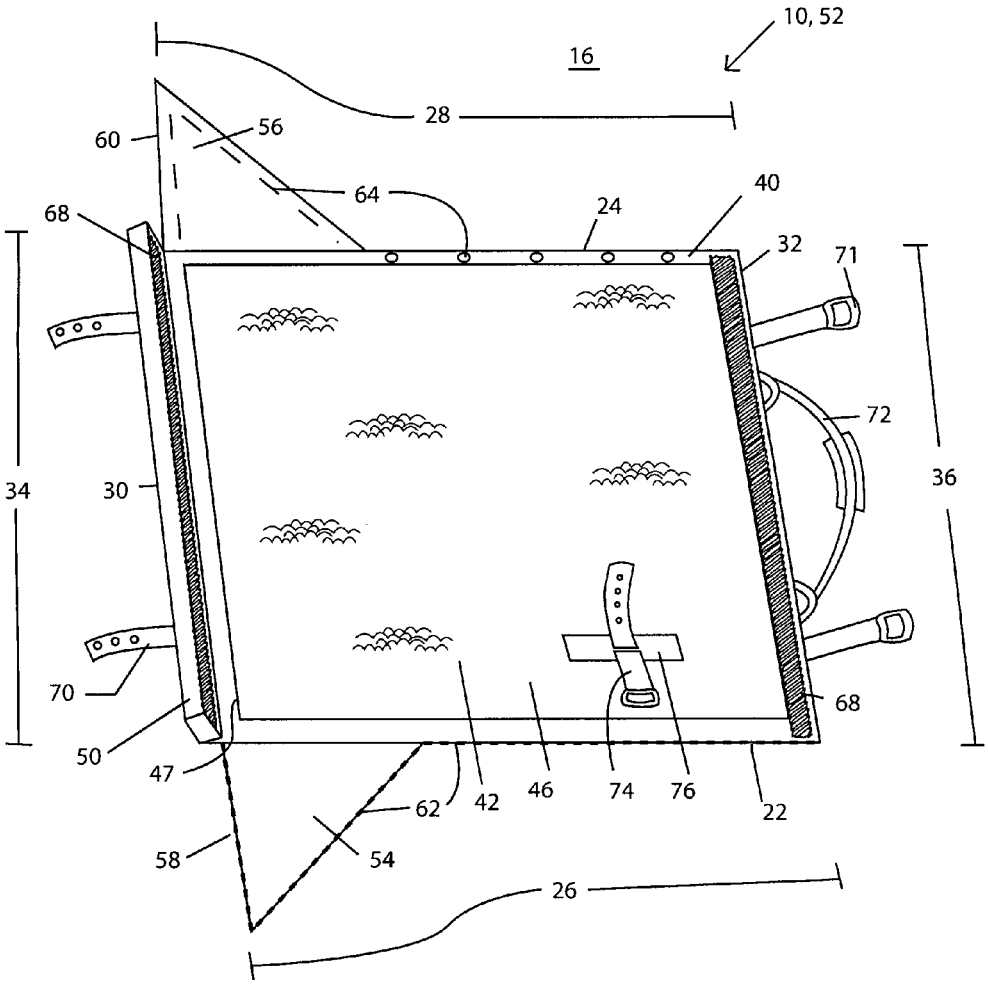
FIG. 2 is a perspective view of another embodiment of the drum rug laid flat on a floor. This figure shows buttons on the right edge and a zipper on the left edge to indicate the variety of connectors that can be used.
Figure 3:
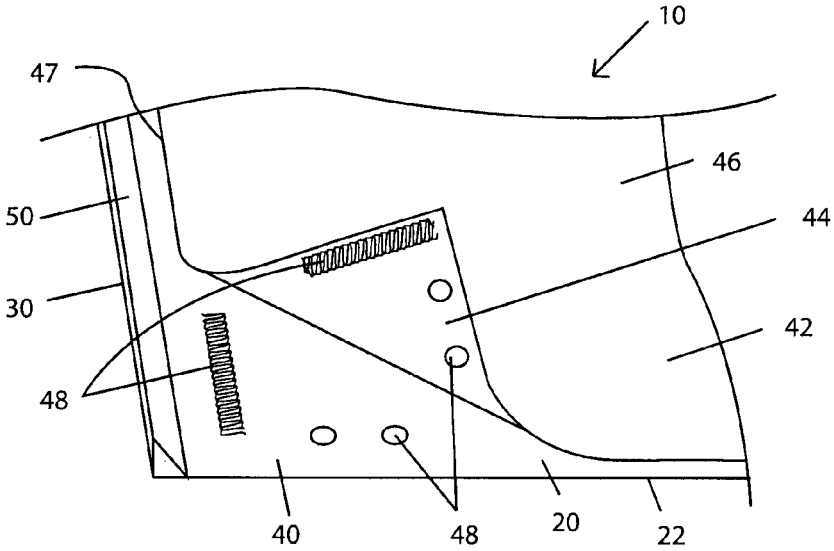
FIG. 3 shows a portion of another embodiment of the drum rug, where the inner layer is pulled back from the outer layer to show the inner layer connectors. The inner layer connectors are depicted as a combination of hook and loop connectors and snap connectors.

A drum rug 10 can be used as a platform for a drum set, as seen in FIGS. 1-3. The drum rug 10 is designed to lay flat on a floor 16, such as a stage floor 16, and to help prevent drums 12 from moving or "walking" during a performance. The bass drum 12 is often struck horizontally with a foot pedal 14, which can tend to gradually move the bass drum 12 as the performance progresses. Other drums 12 are supported by drum stands 13, and the drum stands 13 can also shift during use. The drum rug 10 can be a wide variety of sizes to accommodate different sized drum sets.

Outer Layer

The drum rug 10 comprises an outer layer 20, where the outer layer 20 is the material which directly contacts the floor 16 when in use. The outer layer 20 includes a left edge 22 and a right edge 24, where the left edge 22 has a left edge length 26 and the right edge has a right edge, length 28. The outer layer 20 also has a front edge 30 and a back edge 32, where the front edge 30 has a front edge length 34 and the back edge 32 has a back edge length 36. The front edge 32 is generally the edge closest to the audience during a performance, and the right edge 24 is the edge on the drummer's right as the drummer faces the audience. The outer layer 20 has a floor surface 38 that generally faces and contacts the floor 16 or stage during use as a rug, and a top surface 40 opposite the floor surface 38.

The outer layer 20 should be durable and rugged to withstand foot traffic, equipment set-up and take down, a base for pounding drums 12, and a surface for stage performances. The outer layer 20 should also be a flexible, pliable material, so the outer layer 20 can conform to bumps, bulges, or uneven floors 16. As will be discussed below, the outer layer 20 also should be capable of being folded, and should be rugged and strong enough to carry heavy gear. The material of construction of the outer layer 20 can be nylon fabric, canvas, polyester, or almost any rugged fabric or pliable material. It is even possible to make the outer layer 20 from polymeric sheeting, if desired.

The outer layer 20 is generally rectangular in shape, where a square is one type of rectangle, but other shapes are also possible. Ideally, the outer layer 20 is symmetrical about the line that bisects the front and back edges 30, 32, so many shapes are possible. This includes octagons, convex or concave curved front and back edges 30, 32, or jagged front and back edges 30, 32 and/or jagged left and right edges 22, 24. Many other shapes are also possible. Whatever the shape of the outer layer 20, it should be planar, meaning flat, when lying on the floor 16. That means the outer layer 20 should not have a "cup" shape which would pull the edges up, but should be planar like a household rug or door mat.

Inner Layer

The drum rug 10 can also include an inner layer 42 in some embodiments. The inner layer 42, when present, lies directly on top of the outer layer 20. The inner layer 42 has a bottom surface 44 that faces and contacts the outer layer top surface 40, and the inner layer 42 has a drum surface 46 opposite the bottom surface 44. The inner layer 42 also has an audience edge 47 adjacent to the outer layer front edge 30, so the audience edge 47 is the edge closest to the audience. The drum surface 46 faces upward, or away from the outer layer 20. The drums 12 will generally sit on the inner layer drum surface 46. In some embodiments, the inner layer 42 has the same basic shape as the outer layer 20, but the inner layer 42 can be somewhat smaller so at least some of the outer layer edges 22, 24, 30, 32 are exposed. The inner layer 42 should generally be almost as large as the outer layer 20, so most of the outer layer top surface 40 is covered by the inner layer 42. In other embodiments, the inner layer 42 can be larger than the outer layer 20, and the inner layer 42 may fold to fit within the dimensions of the outer layer 42 for transport.

The drum surface 46 is a non-slip surface, to help prevent the drums 12 from moving or "walking" during a performance. The non-slip material can be carpeting, but it can also be a rubberized mat, a textured fabric, or many other options which tend to minimize slipping. Drum kit hardware usually has rubberized feet or metal cleats for ground contact, so the non-slip material can be selected to minimize slipping of rubberized material or metallic cleats. The inner layer 42 should also be a rugged and durable material, because the inner layer 42 must generally withstand the same uses as the outer layer 20 during a performance, and when used for carrying equipment. The inner layer 42 should also be flexible, pliable, and planar or flat, because the inner and outer layers 42, 20 generally work and move together almost as a single piece. The drum surface 46 can include a logo or design for the band, because the drum surface 46 is the primary surface that is visible during a performance.

The inner layer 42 can be connected to the outer layer 20 to help prevent relative movement, and thus to help prevent overall movement of the drums 12 or other equipment on the drum rug 10. In many cases, the inner layer 42 is releasably connected to the outer layer 20 with inner layer connectors 48, so the inner layer 42 can be changed for different performances, or cleaned between uses, or merely moved separately from the outer layer 20. Removing the inner layer 42 also facilitates cleaning of the outer layer 20, and access for any maintenance that may be needed. Many different types of inner layer connectors 48 can be used. For example, hook and loop fasteners can be used, or snaps, ties, buttons, buckles, or even zippers can be used. Other options are also possible.

Drum Stop

A drum stop 50 is connected to the outer layer front edge 30 in some embodiments, but in other embodiments the drum stop 50 can be connected to the front edge of the inner layer 42. It is also possible for different drum stops 50 to be connected to each of the outer layer front edge 30 and the front edge of the inner layer 42. The drum stop 50 is ridged and durable, and can be made of wood, metal, hard polymers, or other materials that will hold their shape and withstand the wear and tear of a drum rug 10. The drum stop 50 can extend along the entire front edge length 34, but it is also possible for the drum stop 50 to be shorter than the front edge length 34. The drum stop 50 has the same shape as the outer layer front edge 30, and actually helps define the front edge 30. The drum stop 50 can be permanently or releasably connected to the drum rug 10 at the outer layer front edge 30 or the inner layer audience edge 47, as desired.

The drum stop 50 forms a barrier that the bass drum 12, the hi-hat cymbals, or other equipment can abut, so the drum stop 50 can prevent the forward creep or "walking" of this equipment during the repeated horizontal pounding of a performance. Therefore, the drum stop 50 extends upward from the drum rug 10 to provide an edge for the bass drum 12 or other equipment to rest against. That means the drum stop 50 extends over the outer layer top surface 40 and/or the inner layer drum surface 46. The bass drum 12 may include telescoping support legs, which can change the height of the bass drum 12, and therefore can change the minimum height the drum stop 50 must extend to in order to abut the edge of the bass drum 12. However, in some embodiments, the bass drum support legs can abut the drum stop 50, which limits the necessary height for the drum stop 50 because support legs extend to the ground. In some embodiments, the drum stop 50 can extend above the drum rug 10 about ½ to 4 inches, but other heights are also possible. The drum stop 50 should be tall enough that the bass drum 12 does not slide over the top of it, but the drum stop 50 should be short enough that it doesn't interfere with the performance on the stage.

In some embodiments, the cross section of the drum stop 50 is a rectangle, but many other shapes are also possible. A triangular cross section can take less material than a rectangular one, so a triangular cross section may weigh less. A cross section with a lip or overlap that extends back towards the back edge 32 can serve to "hook" the edge of the bass drum 12, and thereby reduce the chances for the bass drum 12 to jump over the top of the drum stop 50. Many other shapes are also possible.

The drum rug 10 can also include other barriers at different locations, in some embodiments. For example, there may be various drum edges (not shown) that extend upward from the drum rug 10 at several locations on the drum surface 46. These different drum edges can secure other drums or cymbals in place by holding the legs of the stands for the snare, or for the floor tom, or for different cymbals. These additional barriers can also mark fixed points on the drum rug 10 to facilitate rapid and accurate equipment placement, which can reduce set-up time and increase the consistency of equipment placement after a move.

Gig Bag

Figure 4:
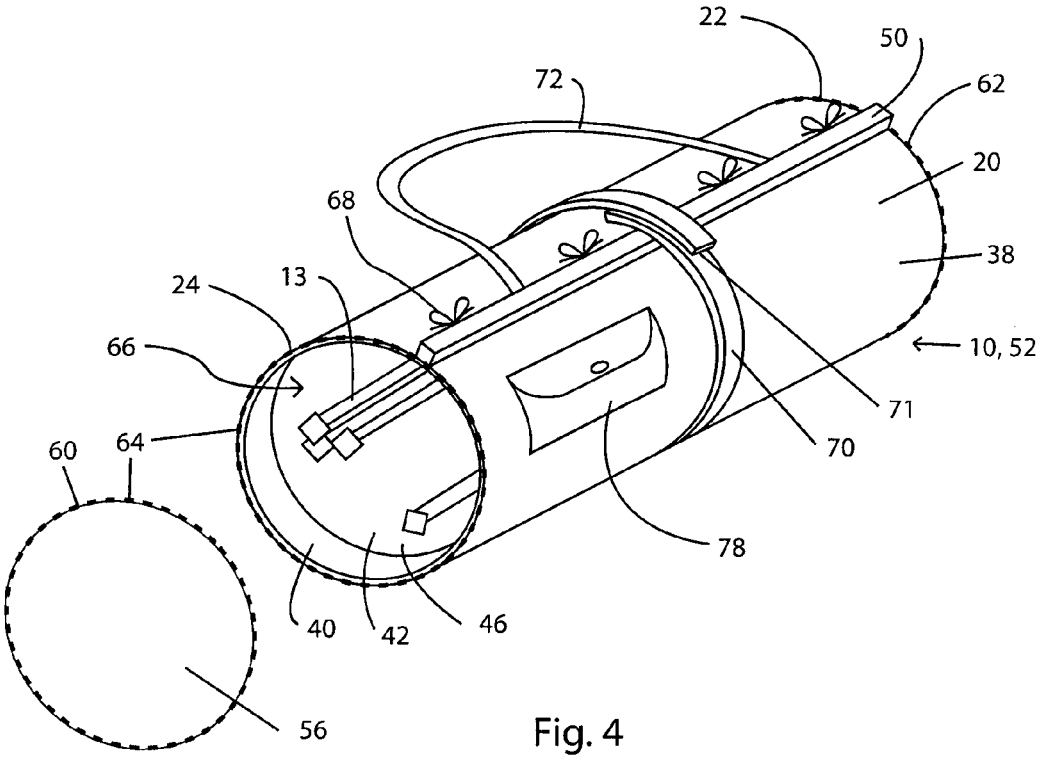
FIG. 4 shows a perspective view of the drum rug when converted to a gig bag, with equipment shown inside the gig bag.

The drum rug 10 converts into a gig bag 52 for travel, as seen in FIG. 4, with continuing reference to FIGS. 1-3.

Because the drum rug 10 converts to a gig bag 52, and vice versa, the current invention is a drum rug 10 and gig bag 52 in one. The gig bag 52 is actually the same thing as the drum rug 10, except the gig bag 52 is rolled or folded and connected together to form a carrying bag for whatever the user wants to carry. The gig bag 52 can be used for band equipment, such as drum stands 13, pedestals, floor pedals 14, microphones, wiring, drum sticks, or anything else that needs to be moved.

End Flaps

The primary method used to convert the drum rug 10 into the gig bag 52 is to secure left and right end flaps 54, 56 to the outer layer left and right edges 22, 24, respectively. The left end flap 54 has a left end flap perimeter 58, and the right end flap 56 has a right end flap perimeter 60. The left end flap perimeter 58 and the outer layer left edge 22 have a left flap connector 62 that releasably connects the left flap perimeter 58 to the outer layer left edge 22. The right end flap perimeter 60 and the outer layer right edge 24 have a right flap connector 64 that releasably connects the right flap perimeter 60 to the outer layer right edge 24.

The left and right end flaps 54, 56 extend from the outer layer left and right edges 22, 24, respectively. The left and right end flap perimeters 58, 60 include the entire perimeter of the left and right end flaps 54, 56, respectively, including any portion of the end flap perimeters 58, 60 that may be permanently connected to the outer layer left and right edges 22, 24. The left end flap perimeter 58 has a length that is essentially the same as the outer layer left edge length 26, and the right end flap perimeter 60 has a length that is essentially the same as the outer layer right edge length 28. Therefore, essentially the entire left end flap perimeter 58 can be connected along a single joint to essentially the entire outer surface left edge 22, and essentially the entire right end flap perimeter 60 can be connected along a single joint to essentially the entire outer surface right edge 24.

The connection of the left and right end flaps 54, 56 to the entire outer layer left and right edges 22, 24 converts the drum rug 10 to the gig bag 52. Essentially the entire length of the left and right end flap perimeters 58, 60 are connected to the outer layer left and right edges 22, 24, which folds or rolls the drum rug 10 and brings the outer layer front and back edges 30, 32 together to form an enclosure 66. As mentioned previously, the drum rug 10 is essentially symmetrical about the line bisecting the front and back edges 30, 32, so the drum rug 10 folds into a container with the front and back edges 30, 32 meeting when the length of the left and right end flap perimeters 58, 60 are connected to the outer layer left and right edges 22, 24, respectively. The folded or rolled shape of the gig bag 52 can be changed by using different shapes for the left and right end flaps 54, 56, and different shaped gig bags 52 may be better suited for carrying different types of equipment.

The rigid drum stop 50 helps the gig bag 52 hold its shape, because the drum stop 50 does not flex and bend like the inner and outer layers 20, 42. Therefore, the drum stop 50 not only serves to anchor the bass drum 12 (or any objects) during a performance, but the drum stop 50 also serves to support the shape of the gig bag 52 for carrying.

In some embodiments, the left and right end flaps 54, 56 have a section that is permanently connected to the outer layer left and right edges 22, 24, and another section that is releasably connected to the outer layer left and right edges 22, 24. In other embodiments, the entire left and right end flaps 54, 56 are releasably connected to the outer layer left and right edges 22, 24. In the embodiments where the left and right end flaps 54, 56 are entirely releasably connected to the outer layer left and right edges 22, 24, the user should be careful to avoid misplacing the left and right end flaps 54, 56 when the drums 12 are set up on the drum rug 10. There are many different types of connectors that can be used for the left and right flap connectors 62, 64, including zippers and buttons, as shown on opposite sides in FIGS. 1 and 2. Other types of connectors that can be used include, but are not limited to, ties, buckles, hook and loop, or snaps.

In some embodiments, there is a back edge connector 68 that secures the outer layer back edge 32 to the outer layer front edge 30. This essentially secures the enclosure 66 shut. In other embodiments, the outer layer back and front edge 32, 30 are not connected, and the top of the gig bag 52 remains open for easy access. The drum rug 10 can be symmetrical about the line that bisects the front and back edges 30, 32, so the front and back edges 30, 32 can have essentially the same length 34, 36. The back edge connector 68 can have engaging portions on each of the front and back edges 30, 32, and many types of connectors can be used, as described above. The inner layer 42 may be dimensioned somewhat smaller than the outer layer 20 such that the left, right, front, and back edges 22, 24, 30, 32 of the outer layer 20 are not covered by the inner layer 42. This facilitates the connection of the left and right flap connectors 62, 64 and the back end connector 68, because the inner layer 42 is not blocking the mechanism of the connectors 62, 64; 68.

Straps and Accessories

The gig bag 52 can include several different straps and accessories to facilitate use, but the straps and accessories are optional. For example, one or more cinch straps 70 can wrap around the gig bag 52 to cinch the gig bag 52 about the contents of the enclosure 66. The cinch strap 70 can essentially wrap about a line parallel with the line that bisects the outer layer front and back edges 30, 32, but in other embodiments the cinch strap 70 can run in different directions. The cinch strap 70 can be a solid belt that connects together at opposite ends, after wrapping around the gig bag 52, or the cinch strap 70 can be two separate pieces that are secured to the outer layer floor surface 38 such that the two separate pieces can draw the gig bag 52 tight about the contents of the enclosure 66. The cinch strap 70 can be permanently or removably connected to the gig bag 52, or it can be a separate piece, as desired. The cinch strap 70 should have opposite ends that can be adjustably and releasably connected together by a cinch strap connector 71, so the cinch strap 70 can be pulled to different lengths for different contents of the gig bag 52. The cinch strap connector 71 can be a buckle, hook and loop, ties, buttons, snaps, or a wide variety of different connector types.

A carrying loop 72 can be secured to the outer layer floor surface 38, the drum stop 50, or any other location that makes the carrying loop 72 accessible while the gig bag 52 is closed up. For example the carrying loop 72 could be connected to the outer layer top surface 40, and extend out of a gap between the front and back edges, or the carrying loop 72 could be connected to one or more of the end flaps 54, 56. The carrying loop 72 can have padding to comfort the user when shouldering a heavy gig bag 52, and the carrying loop 72 can be removable with attachment points for use when needed. The carrying loop 72 can be coupled with wheels attached to the gig bag 52 for easy handling, if desired. The carrying loop 72 can be sized to carry the gig bag 52 over a user's shoulder, or the carrying loop 72 can be sized for one hand to grab, and other sizes are also possible.

Figure 5:
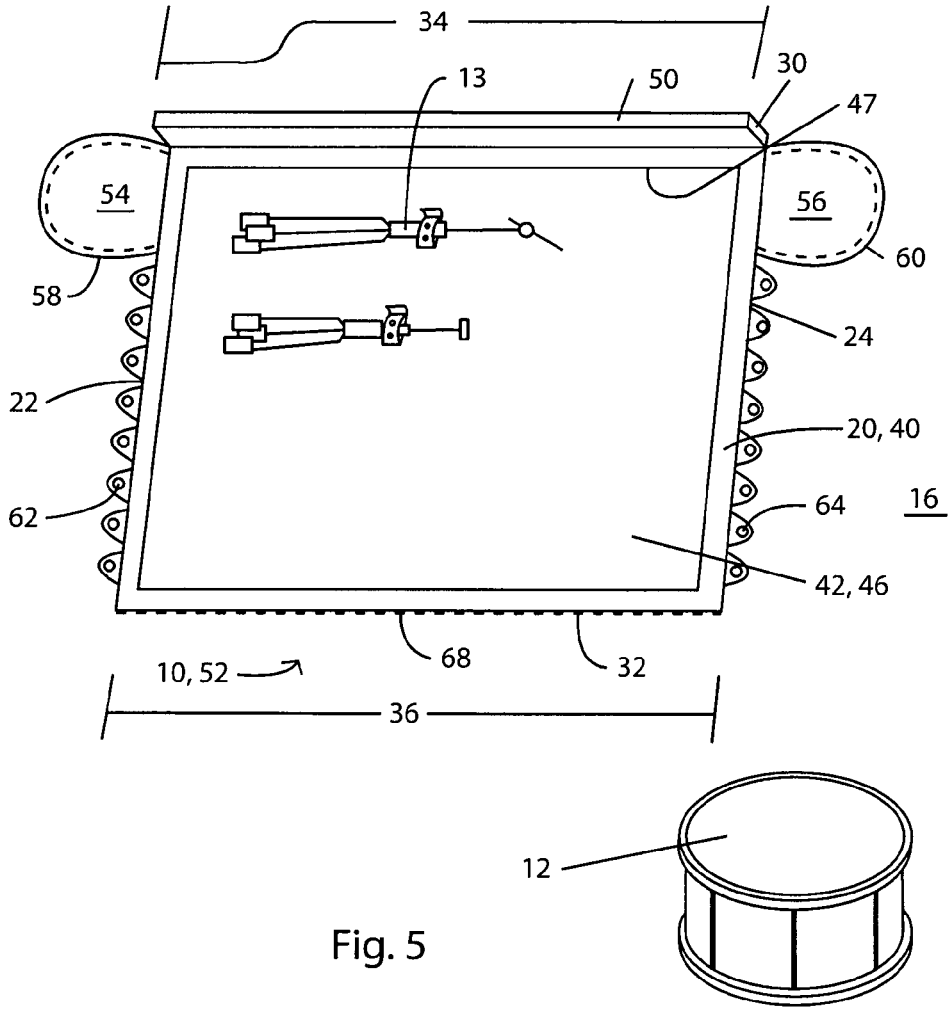
FIG. 5 shows a perspective view showing equipment being loaded onto the drum rug prior to converting the drum rug to a gig bag.

A retaining strap 74 can be used to secure a drum stand 13 or other equipment in the gig bag 52, as seen in FIG. 5, with continuing reference to FIGS. 1-4. The drum stand 13 is folded into a transport position before loading in the gig bag 52. The retaining strap 74 can be secured to the outer layer top surface 40, and there can be a retaining gap 76 defined in the inner layer 42, where the retaining gap 76 is positioned above the location where the retaining strap 74 is secured to the outer layer 20. The retaining strap 74 can then pass through the retaining gap 76, and then be used to secure a drum stand 13 or other equipment in the enclosure 66. In other embodiments, the retaining strap 74 can be connected to the inner layer drum surface 46. The retaining strap 74 has opposite ends that can be secured together about an object in the gig bag 52 using a connector of some type, such as but not limited to buckles, ties, hook and loop, snaps, or buttons. The retaining strap 74 can also be used to secure a drum stand 13 or other equipment in place during a performance.

The gig bag 52 can include one or more pockets 78 in a wide variety of locations. For example, the pocket 78 can be on the outer layer floor surface 38, the inner layer drum surface 46, the left or right end flap 54, 56, or even on the carrying loop 72 or the outer layer top surface 40. The pocket 78 can be used to store straps, or smaller equipment, and the pocket 78 should collapse to a relatively flat profile for when the gig bag 52 is used as a drum rug 10. In general, the straps and accessories should collapse to a relatively flat profile for use as a drum rug 10. A small hump or bump from a strap or accessory may be acceptable during a performance, but many drummers prefer a flat surface for setting up their drum sets.

In use, the drum rug 10 is laid flat on a stage or the floor 16, any equipment on the drum rug 10 is moved, and a set of drums 12 are set up on the drum rug 10. After a performance, the drums 12 are taken down, and the drum stands 13 are folded into a transport position. The drum stands 13 and other equipment are laid out on the flat drum rug 10, and some equipment can be secured to the drum rug 10 with retaining straps. The left and right end flaps 54, 56 are secured to the left and right outer layer edges 22, 24 such that the drum rug 10 folds and rolls into a gig bag 52 with the equipment in the enclosure 66. The front and back edges 30, 32 may be connected together, the gig bag 52 is carried to the next gig, and the process is repeated.

While the invention has been described with respect to a limited number of embodiments, those skilled in the art, having the benefit of this disclosure, will appreciate that other embodiments can be devised which do not depart from the scope of the invention as disclosed here.

What is claimed is:

1. A drum rug comprising:

a flexible outer layer having a floor surface opposite a top surface, a front edge, a left edge having a left edge length, and a right edge having a right edge length;

a flexible inner layer removably connected to the top surface of the outer layer, where the inner layer has a non-slip drum surface facing away from the outer layer;

a rigid drum stop permanently fixed to one of the outer layer front edge or an inner layer audience edge, where the drum stop extends upwards above the inner layer;

a left flap connected to the outer layer left edge, where the left flap has a left flap perimeter with a length approximately equal to the outer layer left edge length;

a right flap connected to the outer layer right edge, where the right flap has a right flap perimeter with a length approximately equal to the outer layer right edge length;

a left flap zipper positioned on the left flap perimeter and the left edge, and where the left flap zipper releasably connects the left flap perimeter to the left edge such that when the drum rug is rolled or folded, essentially the entire left flap perimeter is connected to the outer layer left edge;

a right flap zipper positioned on the right flap perimeter and the right edge, and where the right flap zipper releasably connects the right flap perimeter to the right edge such that that when the drum rug is rolled or folded, essentially the entire right flap perimeter is connected to the outer layer right edge;

a cinch strap connected to the outer layer floor surface, and an adjustable cinch strap connector attached to the cinch strap; and a carrying loop connected to the drum rug.

2. The drum rug of claim 1 further comprising a retaining strap connected to the outer layer top surface, where the inner layer defines a retaining gap positioned over the retaining strap such that the retaining strap passes through the retaining gap.

3. The drum rug of claim 1 where the flexible outer layer comprises a planar position.

4. A drum rug comprising:

a flexible outer layer having a planar position, where the outer layer has a floor surface, a top surface, a front edge, a left edge having a left edge length, and a right edge having a right edge length;

a rigid drum stop permanently fixed to the outer layer front edge, where the drum stop extends upwards over the floor surface of the outer layer;

a left flap connected to the outer layer left edge, where the left flap has a left flap perimeter with a length approximately equal to the outer layer left edge length;

a right flap connected to the outer layer right edge, where the right flap has a right flap perimeter with a length approximately equal to the outer layer right edge length;

a left flap zipper positioned on the left flap perimeter and the left edge, and where the left flap zipper releasably connects the left flap perimeter to the left edge;

a right flap zipper positioned on the right flap perimeter and the right edge, and where the right flap zipper releasably connects the right flap perimeter to the right edge.

5. The drum rug of claim 4 where a portion of the left flap is permanently connected to the outer layer left edge, and a portion of the right flap is permanently connected to the outer layer right edge.

6. The drum rug of claim 5 where the portion of the left flap that is permanently connected to the outer layer left edge is straight, and the portion of the right flap that is permanently connected to the outer layer right edge is straight, such that the drum rug lays flat when the left and right flap zippers are released.

7. The drum rug of claim 4 where the entire left flap is releasably connected to the outer layer left edge, and the entire right flap is releasably connected to the outer layer right edge.

8. The drum rug of claim 4 further comprising a flexible inner layer releasably connected to the outer layer top surface, where the inner layer comprises a non-slip drum surface opposite the outer layer.

9. The drum rug of claim 4 further comprising a cinch strap connected to the outer layer floor surface, and an adjustable cinch strap connector attached to the cinch strap.

10. The drum rug of claim 4 further comprising a carrying loop connected to the outer layer floor surface.

11. The drum rug of claim 4 further comprising a retaining strap connected to the outer layer top surface.

12. The drum rug of claim 4 where the outer layer further comprises a back edge and a back edge connector, where the back edge connector releasably connects the front edge to the back edge.

13. The drum rug of claim 4 further comprising a pocket on the outer layer.

14. A method of transporting equipment comprising:

(a) folding a drum stand into a transport position;

(b) placing the drum stand on a flat drum rug, where the drum rug comprises left and right end flaps and outer layer left and right sides, where the drum rug further comprises a ridged drum stop at an outer layer front edge and an inner layer removably connected to a top surface of the outer layer, where the inner layer has a non-slip drum surface facing away from the outer layer;

(c) rolling or folding the drum rug and closing a right flap zipper such that essentially an entire right flap perimeter is connected to essentially the entire outer layer right side;

(d) rolling or folding the drum rug and closing a left flap zipper such that essentially an entire left flap perimeter is connected to essentially the entire outer layer left side, such that an outer layer back edge and an outer layer front edge are brought together as the left and right flap zippers are closed to form an enclosure; and (e) lifting and carrying the drum rug with the drum stand positioned within the enclosure.

15. The method of claim 14 further comprising:

securing a cinch strap around the drum rug prior to step (e).

16. The method of claim 14 further comprising:

connecting the outer layer front edge to the outer layer back edge prior to step (e).

17. The method of claim 14 further comprising:

securing the drum stand to the drum rug with a retaining strap, where the retaining strap is permanently fixed to the drum rug.

18. The method of claim 14 where the drum stop projects beyond a surface of the drum rug.

19. The method of claim 14 further comprising:

placing the drum rug on the floor after step (e);

opening the left and right flap connectors;

laying the drum rug flat;

unfolding the drum stand; and placing the unfolded drum stand on the drum rug.

* * * * *